US006304226B1

(12) United States Patent
Brown et al.

(10) Patent No.: US 6,304,226 B1
(45) Date of Patent: Oct. 16, 2001

(54) FOLDED CAVITY-BACKED SLOT ANTENNA

(75) Inventors: Kenneth W. Brown; Thomas A. Drake, both of Yucaipa, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/385,646

(22) Filed: Aug. 27, 1999

(51) Int. Cl.[7] ..... H01Q 1/28
(52) U.S. Cl. ..... 343/767; 343/768; 343/872
(58) Field of Search ..... 343/767, 768, 343/746, 771, 772, 872, 769, 873

(56) References Cited

U.S. PATENT DOCUMENTS

| | | | | |
|---|---|---|---|---|
| H1151 | * | 3/1993 | Peterson, Jr. | 343/767 |
| 3,573,834 | | 4/1971 | McCabe et al. . | |
| 4,032,921 | * | 6/1977 | Sikina, Jr. et al. | 343/769 |
| 4,130,823 | | 12/1978 | Hoople . | |
| 4,132,995 | | 1/1979 | Monser . | |
| 4,200,873 | * | 4/1980 | Seeley | 343/769 |
| 4,242,685 | * | 12/1980 | Sanford | 343/770 |
| 4,451,830 | * | 5/1984 | Lucas et al. | 343/768 |
| 4,573,056 | * | 2/1986 | DuDome et al. | 343/795 |
| 4,733,245 | * | 3/1988 | Mussler | 343/873 |
| 4,935,745 | * | 6/1990 | Mori et al. | 343/767 |
| 5,461,393 | | 10/1995 | Gordon . | |
| 5,648,786 | * | 7/1997 | Chung et al. | 343/767 |
| 6,052,093 | * | 4/2000 | Yao et al. | 343/767 |

* cited by examiner

*Primary Examiner*—Don Wong
*Assistant Examiner*—Thuy Vinh Tran
(74) *Attorney, Agent, or Firm*—William J. Benman; Glenn H. Lenzen, Jr.

(57) ABSTRACT

An antenna that includes a housing having a plurality of walls forming an enclosure, a slot formed in a first wall of the housing, and, a folded cavity formed in a second wall of the housing opposite the first wall. The folded cavity is preferably a compound cavity that includes a first cavity portion and a second cavity portion joined around their entire respective peripheries by a fold or shelf. Any convenient RF transmission line, e.g., a waveguide or coaxial cables, can be used to inject RF energy into the folded cavity. In certain embodiments, both the width and length of the housing are each less than ½ of a free-space wavelength, and the antenna is capable of producing very accurate circular polarization and is capable of handling very high power levels, e.g., 10 kW, thereby making it suitable for high power applications which require extremely compact antenna elements, e.g., wide-scan phased array antennas.

20 Claims, 3 Drawing Sheets

FOLDED CAVITY-BACKED SLOT ANTENNA

BACKGROUND OF THE INVENTION

1. Field of the Invention

The present invention relates to antennas. More specifically, the present invention relates to slot antennas used in high-power applications.

2. Description of the Related Art

The individual antenna elements of a wide-scan phased array antenna (e.g., one capable of scanning very wide angles such as +/−45°) must typically be spaced very close together. More specifically, the individual antenna elements must generally be spaced approximately one-half of a free-space wavelength apart from one another. There are a variety of antenna elements that are of such compact design. However, none of the presently available antennas, compact enough for use in a wide-scan phased array antenna, are capable of handling very high average power levels while simultaneously providing very accurate polarization, e.g., circular polarization, over a very large angular region (e.g., +/−50° in both planes). In this connection, there are a number of applications, including high-power wide-scan phased array antennas, that require an extremely compact antenna design that satisfies these constraints. The following brief review of the presently available antenna technology should serve to illustrate the limitations and shortcomings thereof. Circularly polarized patch antennas can be made smaller than one-half of a free-space wavelength, but only through the use of a dielectric, thereby rendering the patch antenna inadequate for high power applications. A circularly polarized ridged waveguide antenna having a slot formed in a surface thereof can be made smaller than one-half of a free-space wavelength. Although such an antenna design can handle high power levels, it is not capable of providing accurate circular polarization.

A rectangular cavity-backed slot antenna can be constructed that can handle high power levels (i.e., no dielectric is required). However, the cross-sectional dimensions of the cavity must be greater than one-half of a free-space wavelength (typically, 7/10th of a wavelength on edge) for the device to be operative. The reason that the dimensions of the cavity must be greater than one-half of a free-space wavelength is due to the fact that in order for the cavity to resonate, the rectangular dimensions must be equal to one-half of a guide wavelength, which is longer than the free-space wavelength.

The size of a conventional cavity-backed slot antenna can be reduced by filling the cavity with a dielectric material, but this introduces substantial losses and renders the antenna inadequate for high average power applications.

Other known antenna designs include those disclosed in U.S. Pat. No. 3,573,834, issued to McCabe et al.; U.S. Pat. No. 4,130,823, issued to Hoople; U.S. Pat. No. 4,132,995, issued to Monser; and, U.S. Pat. No. 5,461,393, issued to Gordon. However, the antennas disclosed in these patents are either too Large, have poor circular polarization performance, and/or can not handle high power levels.

Thus, there is a need in the art for an extremely compact antenna that is capable of handling high power levels and providing very accurate polarization, e.g., for use in high-power applications that require radiation of very accurate circular polarization over a very large angular region (e.g., +/−50° in both planes), such as in wide-scan phased array antennas.

SUMMARY OF THE INVENTION

The need in the art is addressed by the compact, folded cavity-backed slot antenna of the present invention. In one of its aspects, the present invention encompasses an antenna that includes a housing having a plurality of walls forming an enclosure, a slot formed in a first wall of the housing, and, a folded cavity formed in a second wall of the housing opposite the first wall. The folded cavity is preferably a compound cavity that includes a first cavity portion and a second cavity portion joined around their entire respective peripheries by a fold or shelf. Any convenient RF transmission line, e.g., a waveguide or coaxial cables, can be used to inject RF energy into the folded cavity.

In one embodiment, the slot is cross-shaped, and coaxial cables that transmit RF signals that are 90° out-of-phase are used to feed the folded cavity in respective orthogonal directions, whereby the cross-shaped slot produces accurate, circularly polarized radiation.

In another embodiment that was built and extensively tested, the slot is cross-dumbbell-shaped, and a ridged waveguide is used to feed the folded cavity. In this embodiment, an amount of cavity fold is greater in a first direction than it is in a second direction, whereby the folded cavity resonates at different frequencies for RF energy of different polarizations. Further, a coupling post is provided to coupled RF energy of a first polarization to RF energy of a second polarization, whereby the slot produces accurate, circularly polarized radiation.

In both embodiments, at least one of the width and length dimensions of the housing is less than 7/10th of a free-space wavelength and, preferably, both the width and length of the housing are each less than ½ of a free-space wavelength. With either of these embodiments, the antenna is capable of producing very accurate circular polarization and is capable of handling very high average power levels, e.g., 10 kW, thereby making it suitable for high power applications which require extremely compact antenna elements, e.g., wide-scan phased array antennas.

The present invention also encompasses, in another of its aspects, a phased array antenna that includes a plurality of antenna elements each of which is constructed in accordance with the present invention.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
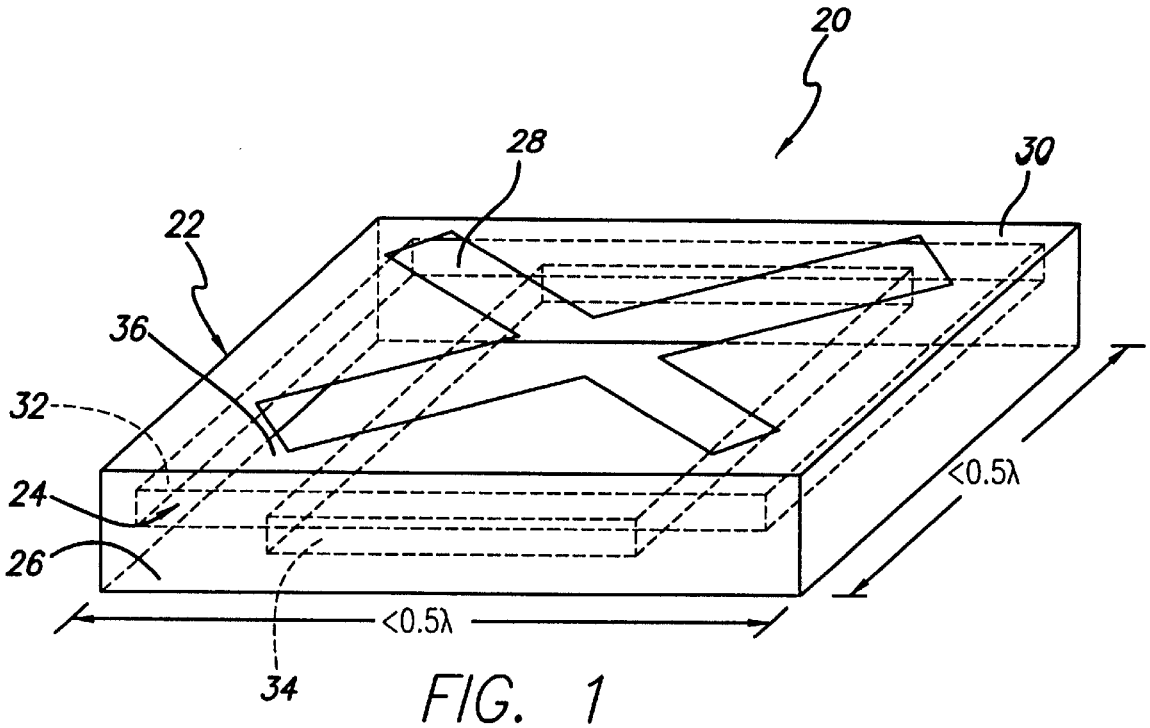
FIG. 1 is an isometric view of the folded cavity-backed slot antenna of an embodiment of the present invention.

With reference now to FIG. 1, there can be seen an isometric view of a folded cavity-backed slot antenna 20 of an exemplary embodiment of the present invention. The folded cavity-backed slot antenna 20 includes a housing 22 that has a folded rectangular cavity 24 formed in a bottom cavity wall 26 in accordance with a novel aspect of the present invention, and a slot 28 machined in the top cavity wall 30. The housing 22 may be constructed of aluminum or other suitable conductive material.

The folded rectangular cavity 24 can be thought of as being formed by folding a standard rectangular cavity behind itself in two dimensions. This folded cavity design allows the antenna 20 to be less than ½ wavelength on edge, making it compact enough to use as an antenna element in a large scan phased array antenna. This size reduction relative to the standard rectangular cavity design of the prior art is accomplished without the use of dielectric material, thereby enabling the antenna 20 to be used in high power applications.

The antenna 20 can be fed with a waveguide, coaxial cables, or any other RF transmission line. The antenna 20 can be configured to produce a circularly polarized radiation pattern. For example, in the embodiment depicted in FIG. 1, the slot 28 is cross-shaped, to thereby produce a circularly polarized radiation pattern. Of course, the slot 28 can be formed by machining two orthogonal slots in the top cavity wall 30 to form the shape of a cross.

Figure 2:
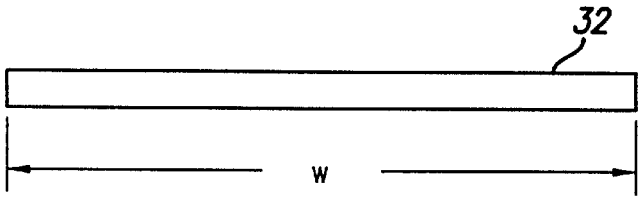
FIG. 2 is a cross-sectional view of the folded cavity of a conventional folded cavity-backed slot antenna.

FIG. 2 is a cross-sectional view of a standard rectangular cavity 32 of the prior art, in one dimension, e.g., the width dimension. The width of the cavity 32 is designated "w".

Figure 3:
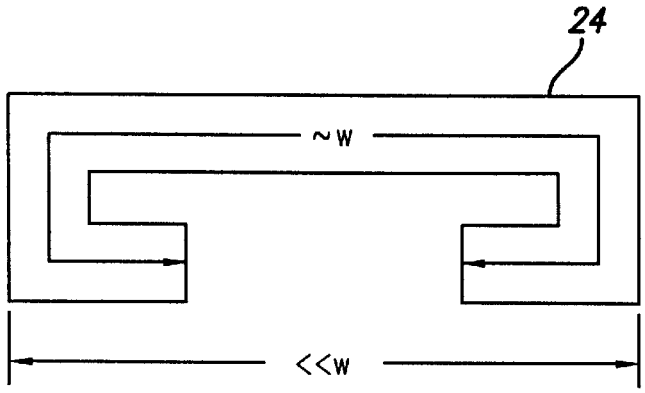
FIG. 3 is a cross-sectional view of the folded cavity of the folded cavity-backed slot antenna depicted in FIG. 1.

FIG. 3 is a cross-sectional view of the folded rectangular cavity 24 of the present invention, in one dimension, e.g., the width dimension. The width of the folded cavity 24 is designated "<<w", to thereby indicate that the width of the folded cavity 24 of the present invention is significantly less than the width of the "non-folded" cavity 32 of tile prior art. Note that the total folded width of the cavity is approximately equal to "w", as shown in FIG. 3. Of course, this same size reduction is achieved in the orthogonal dimension, e.g., the length dimension, of the folded cavity 24, by virtue of the folded cavity being "folded back" along its length, as well as its width.

Of course, this folding back of the standard rectangular cavity in orthogonal dimensions results in a "compound" cavity comprised of a first cavity portion 32 and a second cavity portion 34 joined around their entire peripheries by a fold or shelf 36. Of course, the particular shape of the cavity is not limiting to the present invention, in its broadest aspect.

Figure 4:
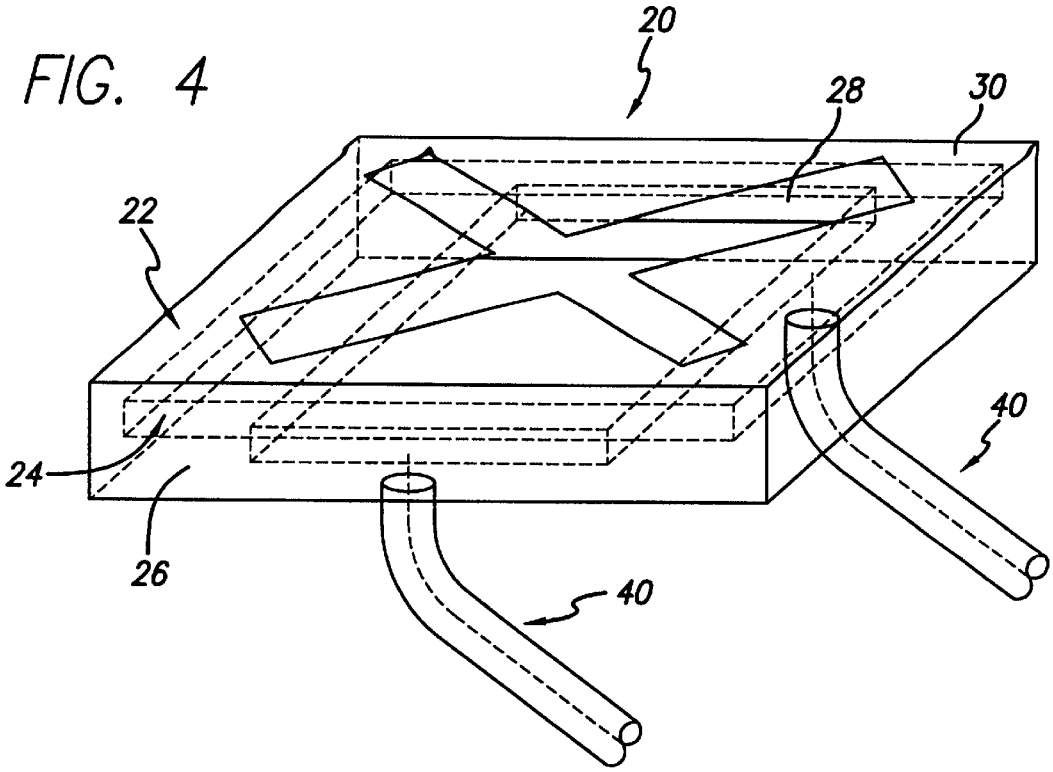
FIG. 4 is an isometric view of the folded cavity-backed slot antenna of the present invention fed with coaxial cables.

FIG. 4 is an isometric view of the embodiment of the folded cavity-backed antenna 20 depicted in FIG. 3 shown being fed with a pair of coaxial cables 40. Each of the coaxial cables 40 feeds the folded cavity 24 in a respective one of its two orthogonal directions. If the coax signals are 90° apart in phase, the folded cavity-backed slot 28 will radiate circular polarization.

Figure 5:
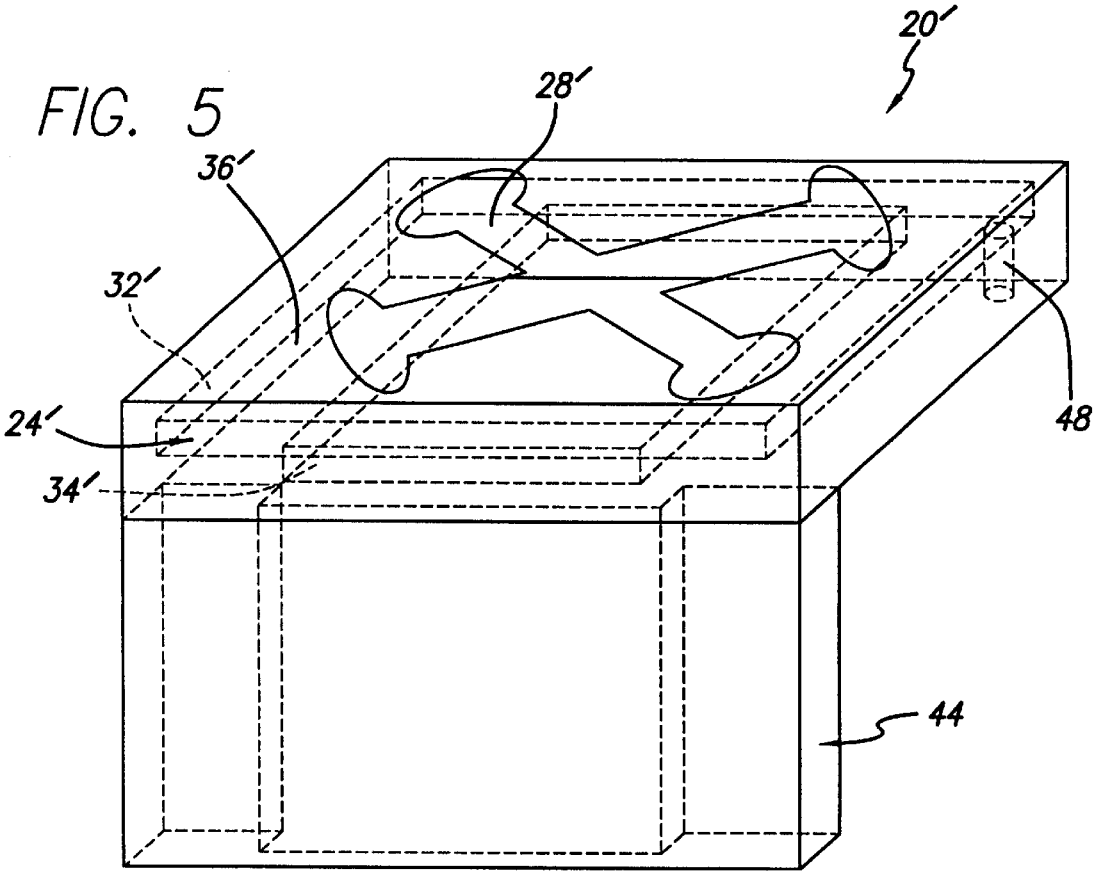
FIG. 5 is an isometric view of another embodiment of the folded cavity-backed slot antenna of the present invention fed with a ridged waveguide.

FIG. 5 is an isometric view of another embodiment of a folded cavity-backed antenna 20' of the present invention. In this embodiment, the antenna 20' is fed with a ridged waveguide 44. The ridged waveguide 44 can be made narrower than a standard rectangular waveguide, e.g., approximately ½ wavelength on edge. Further, in this embodiment, a cross-"dumbbell"-shaped slot 28' was employed in order to produce a very broad radiation pattern. The ridged waveguide feed 44 only couples energy into the cavity in one polarization. In order to obtain circular polarization, the folded cavity 24' is required to resonate in both polarizations. This is achieved in this embodiment of the invention by inclusion of a coupling post 48 to couple energy from one polarization into the other polarization.

Further, in order to obtain circular polarization, the two polarizations of the folded cavity 24' are required to resonate at slightly different frequencies. This is achieved in this embodiment of the invention by making the amount of cavity fold greater for one polarization than the other polarization. This is accomplished by making the base of the folded cavity 34' unsymmetrical.

The folded cavity-backed antenna 20' of this embodiment (i.e., the one depicted in FIG. 5) was built and extensively tested.

Figure 6:
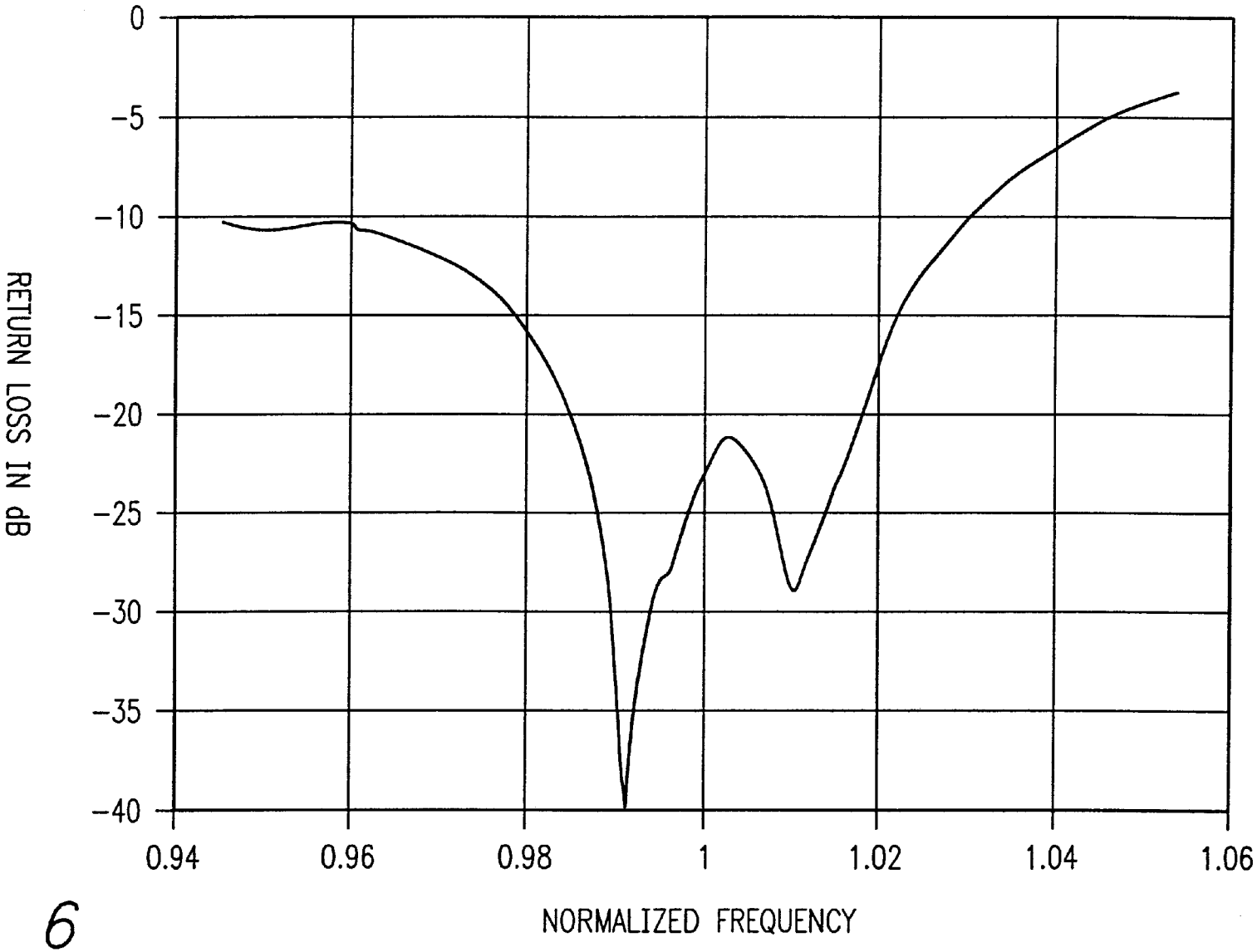
FIG. 6 is a graph plotting return loss versus frequency, at the ridged waveguide input port of the folded cavity-backed slot antenna of the present invention depicted in FIG. 5.

FIG. 6 is a graph plotting return loss versus frequency, at the ridged waveguide input port of the folded cavity-backed slot antenna 20' of the present invention depicted in FIG. 5. As can be seen with reference to this plot, the return loss at the center (design) frequency is less than −20 dB, and is also less than −20 dB over approximately a 3% bandwidth. Also, note the double resonance nature of the return loss, which is due to the two polarizations of the folded cavity 24' resonating at different frequencies in order to produce circularly polarized radiation, as explained above. The radiated axial ratio for this embodiment (i.e., the embodiment depicted in FIG. 5) was also tested, and it was determined that at the center frequency the axial ratio was close to zero, and that further, the axial ratio for the folded cavity 24' was less than 3 dB over approximately a 2% bandwidth. Further, this embodiment (i.e., the embodiment depicted in FIG. 5) was also tested under high power. In particular, average power in excess of 10 kW was applied to the antenna 20' with no resulting degradation.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof. For example, although the present invention has particular utility for use in phased array antennas, the present invention can also be used in a number of other applications, e.g., in industrial heating and/or cooking applications.

It is therefore intended by the appended claims to cover any and all such applications, modifications and embodiments within the scope of the present invention.

Accordingly,

What is claimed is:

1. An antenna comprising:

a housing having a plurality of walls forming an enclosure;

a slot formed in a first wall of the housing; and, a folded cavity formed in a second wall of the housing opposite the first wall.

2. The antenna of claim 1 further comprising means for injecting RF energy into the folded cavity, whereby the slot produces radiation.

3. The antenna of claim 2 wherein the means for injecting comprises coaxial transmission cables.

4. The antenna of claim 2 wherein the means for injecting comprises a waveguide.

5. The antenna of claim 2 wherein the means for injecting comprises a ridged waveguide.

6. The antenna of claim 5 further comprising a coupling post that couples RF energy of a first polarization to RF energy of a second polarization, whereby the slot produces circularly polarized radiation.

7. The antenna of claim 6 wherein the folded cavity comprises a compound cavity comprised of a first cavity portion and a second cavity portion joined around their entire respective peripheries by a shelf.

8. The antenna of claim 7 wherein an amount of cavity fold is greater in a first direction than it is in a second direction, whereby the folded cavity resonates at different frequencies for RF energy of different polarizations.

9. The antenna of claim 7 wherein the folded cavity is configured to resonate at a first frequency for RF energy of a first polarization, and to resonate at a second frequency for RF energy of a second polarization.

10. The antenna of claim 9 wherein the slot is cross-shaped.

11. The antenna of claim 1 wherein the folded cavity comprises a compound cavity comprised of a first cavity portion and a second cavity portion joined around their entire respective peripheries by a shelf.

12. The antenna of claim 1 wherein the slot is cross-dumbbell-shaped.

13. The antenna of claim 1 wherein the slot is cross-shaped.

14. The antenna of claim 13 wherein the slot is cross-dumbbell-shaped.

15. The antenna of claim 1 wherein at least one of the length and width dimensions of the housing is less than 7/10th of a free-space wavelength.

16. The antenna of claim 1 wherein at least one of the length and width dimensions of the housing is no greater than ½ of a free-space wavelength.

17. A phased array antenna comprised of a plurality of antenna elements, wherein each of the antenna elements comprises:

a housing having a plurality of walls forming an enclosure;

a slot formed in a first wall of the housing; and, a folded cavity formed in a second wall of the housing opposite the first wall.

18. The phased array antenna of claim 17 further comprising means for injecting RF energy into the folded cavity of each of the antenna elements, whereby the slot of each antenna element produces radiation.

19. An compact, folded cavity-backed slot antenna comprising:

a housing having a plurality of walls forming an enclosure, wherein at least one of the length and width dimensions of the housing is no greater than ½ of a free-space wavelength;

a cross-shaped slot formed in a first wall of the housing;

a folded cavity formed in a second wall of the housing opposite the first wall, wherein the folded cavity comprises a compound cavity comprised of a first cavity portion and a second cavity portion joined around their entire respective peripheries by a shelf;

means for injecting RF energy into the folded cavity; and wherein the cross-shaped slot produces circularly polarized radiation.

20. The antenna of claim 19 further comprising a coupling post that couples RF energy of a first polarization to RF energy of a second polarization, and wherein:

the means for injecting comprises a ridged waveguide and the folded cavity is configured to resonate at a first frequency for RF energy of a first polarization, and to resonate at a second frequency for RF energy of a second polarization.

* * * * *